US006107977A

United States Patent [19]

Tassoudji et al.

[11] Patent Number: 6,107,977

[45] Date of Patent: Aug. 22, 2000

[54] HELICAL ANTENNA ASSEMBLY AND TOOL FOR ASSEMBLING SAME

[75] Inventors: Mohammad A. Tassoudji, Cardiff, Calif.; Ronald Gulino, Atlanta, Ga.

[73] Assignee: QUALCOMM Incorporated, San Diego, Calif.

[21] Appl. No.: 09/136,499

[22] Filed: Aug. 19, 1998

[51] Int. Cl.[7] ..... H01Q 1/36

[52] U.S. Cl. ..... 343/895; 343/702

[58] Field of Search ..... 343/895, 702

[56] References Cited

U.S. PATENT DOCUMENTS 5,191,352 3/1993 Branson ..... 343/895

5,612,707 3/1997 Vaughan et al. ..... 343/895

*Primary Examiner*—Don Wong

*Assistant Examiner*—Hoang Nguyen

*Attorney, Agent, or Firm*—Philip R. Wadsworth; Gregory D. Ogrod

[57] ABSTRACT

A helical antenna having a radiator portion formed on a flexible substrate and a rigid substrate with a center feed element electrically connected to the radiator portion. The flexible substrate is supported by a support assembly with the radiator portion spaced substantially equidistant from the center feed element. The support assembly includes a first non-conductive member mounted to one surface of the rigid substrate at a first location, a second non-conductive member mounted to a second surface at the first location, a third non-conductive member mounted to the one surface at a second location spaced from the first location, and a fourth non-conductive member mounted to the second surface at the second location. A tool for assembling the helical antenna is provided having a base member with a plurality of elongated members mounted thereon substantially equidistant from each other and extending outwardly therefrom. A plurality of holes formed in the elongated members removably receive pins when in registration with holes in the flexible substrate. A rotatable tuning cap for fine tuning the antenna may be used having a plurality of tuning elements extending axially with the central antenna axis.

32 Claims, 8 Drawing Sheets

HELICAL ANTENNA ASSEMBLY AND TOOL FOR ASSEMBLING SAME

BACKGROUND OF THE INVENTION

I. Field of the Invention

The present invention relates to helical antennas. More particularly, the present invention relates to a novel and improved antenna assembly, a novel and improved assembly tool and a related method for making helical antennas having coupled radiator segments.

II. Related Art

Contemporary personal communication devices are enjoying widespread use in numerous mobile and portable applications. With traditional mobile applications, the desire to minimize the size of the communication device, such as a mobile telephone for example, led to a moderate level of downsizing. However, as the portable, hand-held applications increase in popularity, the demand for smaller and smaller devices increases dramatically. Recent developments in processor technology, battery technology and communications technology have enabled the size and weight of the portable device to be reduced drastically over the past several years.

One area which affects the size and weight of the portable communications device is the device's antenna. The size and weight of the antenna play an important role in downsizing the communication device. Size of the device is not the only factor that needs to be considered in designing antennas for portable applications. Another factor to be considered in designing antennas is attenuation and/or blockage effects resulting from the proximity of the user's head to the antenna during normal operations. Yet another factor is the characteristics of the communication link, such as, for example, desired radiation patterns and operating frequencies.

An antenna that finds widespread usage in satellite communication systems is the helical antenna. One reason for the helical antenna's popularity in satellite communication systems is its ability to produce and receive circularly-polarized radiation employed in such systems. Additionally, because the helical antenna is capable of producing a radiation pattern that is nearly hemispherical, the helical antenna is particularly well suited to applications in mobile satellite communication systems and in satellite navigational systems.

Conventional helical antennas are made by twisting the radiators of the antenna into a helical structure. A common helical antenna is the quadrifilar helical antenna which utilizes four radiators spaced equally around a core and excited in phase quadrature (i.e., the radiators are excited by signals that differ in phase by one quarter of a period or 90°). The length of the radiators is typically an integer multiple of a quarter wavelength of the operating frequency of the communication device. The radiation patterns are typically adjusted by varying the pitch of the radiator, the length of the radiator (in integer multiples of a quarter-wavelength), and the diameter of the core.

Conventional helical antennas can be made using wire or strip technology. With strip technology, the radiators of the antenna are etched or deposited onto a thin, flexible substrate. The radiators are positioned such that they are parallel to each other, but at an obtuse angle to the sides (or edges) of the substrate. The substrate is then formed, or rolled, into a cylindrical, conical, or other appropriate shape causing the strip radiators to form a helix. Typically, a plastic cover or radome is placed over the antenna elements to protect them from damage.

This conventional strip-made helical antenna, however, is difficult to manufacture. Among the problems associated with conventional helical antennas is the difficulty of ensuring that the field inside the helix is undistorted and is always axially symmetric. This problem is due to the fact that, in conventional strip-made helical antennas, the center feed, bandpass receive filter and low noise amplifier, are all etched or deposited onto a thin flexible substrate which is an extension of the radiator substrate. This arrangement can lead to cracking and/or breakage of the center feed during handling and assembly.

In addition, a helical antenna is difficult to manufacture in effective yields. Because it is formed on the same flexible substrate as the helical radiator elements, the center feed is movable within the cylinder of the helix. The center feed may end up being closer to one side of the cylinder formed by the radiator helix than to the other. This leads to the undesirable effect of creating an uneven radiation pattern in the antenna. Having the center feed coincident with the axis of the helical antenna minimizes the impact of this member on the radiation patterns of the antenna. A still further problem relates to the radome. Because of the way the antenna elements are formed, the radome may be spaced unevenly from the helically wound radiators. This tends to distort the radiation pattern and lowers the efficiency of the antenna.

What is needed, therefore, is a helical antenna that is easy to manufacture, that can be manufactured with high yields cost effectively, and which eliminates the problems associated with conventional helical antennas. Also what is needed is a tool or assembly technique that simplifies the consistent manufacture of high quality helical antennas. As will be made clear below, these goals are achieved with the present invention.

SUMMARY OF THE INVENTION

The present invention comprises a helical antenna having a radiator portion formed on a flexible substrate. A rigid substrate having a center feed element formed on it is electrically connected to the radiator portion. A support assembly supports the flexible substrate in a substantially surrounding relation to the rigid substrate such that the radiator portion is spaced substantially equidistant from the center feed element. The support assembly includes a first non-conductive member mounted to one surface of the rigid substrate at a first location, a second non-conductive member mounted to a second surface of the rigid substrate at the first location, a third non-conductive member mounted to the one surface of the rigid substrate at a second location spaced from the first location, and a fourth non-conductive member mounted to the second surface of the rigid substrate at the second location.

In another aspect, the invention comprises a tool for assembling a helical antenna constructed as above. The assembly tool comprises a base member and a plurality of elongated members extending outwardly from the base member and mounted to the base member substantially equidistant from each other. A plurality of holes or apertures are formed in each of the elongated members for removably receiving pins when the holes are in registration with corresponding holes in the flexible substrate.

In a still further aspect, the invention comprises a helical antenna having a first substrate with a center feed element formed thereon. A radiator portion is formed on a flexible substrate which is wound around the first substrate to form a cylindrical shape having a central longitudinal axis and a substantially helical radiator pattern, the radiator portion being electrically connected to the center feed element. A support assembly supports the flexible substrate in a substantially surrounding relation to the second substrate such that the center feed element is disposed substantially coincident with the central longitudinal axis. A tuning cap for fine tuning the antenna is fitted to the support assembly and has a plurality of tuning elements extending axially in the direction of the central longitudinal axis. The tuning cap is rotatable about the central longitudinal axis to cause the tuning elements to adjustably overlap at least portions of the radiator portion.

A primary feature of this invention is that it enables the cost effective manufacture of helical antennas that result in a relatively high manufacturing yield.

Another feature of the present invention is that it substantially reduces or eliminates the problems of the flexible center feed of conventional helical antennas.

A further feature of the present invention is that it produces an improved helical antenna that has better antenna characteristics than conventional helical antennas.

BRIEF DESCRIPTION OF THE DRAWINGS

The features, objects, and advantages of the present invention will become more apparent from the detailed description set forth below when taken in conjunction with the drawings in which like reference characters identify corresponding elements throughout. Additionally, the left-most digit(s) of a reference number identifies the drawing in which the reference first appears.

DETAILED DESCRIPTION OF THE PREFERRED EMBODIMENTS

I. Overview and Discussion of the Invention

The present invention is directed to a helical antenna having a rigid center feed conductor that is located at the central longitudinal axis of a helically wound flexible substrate on which is formed a plurality of radiator elements. A prototype embodiment of the invention comprises a dual-band helical antenna capable of resonating at two different operating frequencies. According to the prototype embodiment incorporating the features of the invention, two helical antennas are stacked end to end, with one antenna resonating at a first frequency and the other antenna resonating at a second frequency. Each antenna has a radiator portion comprised of one or more helically-wound radiators etched or deposited on a flexible substrate in a known manner. Each antenna also has a feed network, a bandpass receive filter and a low noise amplifier (LNA) etched or deposited or otherwise formed on a rigid multi-layer substrate.

Tabs on the flexible substrate are provided to feed signals to the feed network and radiators formed on the flexible substrate. The tabs extend from the substrate and are soldered or otherwise electrically connected to the center feed structure. Non-conductive support members are mounted to the rigid substrate.

When the antenna is formed into a cylinder or other appropriate shape, the support members support the flexible substrate so that the radiators are maintained at a fixed spacing from the center feed. In addition, in a preferred embodiment, the support members have extensions formed on them which protrude through aligned openings in the flexible substrate. These extensions act as guides and spacers for a non-conductive cover (or radome) that encases the antenna elements for protection. The extensions act as spacers to maintain the radome in a fixed spaced relationship to the radiators. The manner in which this is accomplished is described in detail below.

II Example Environment

In a broad sense, the invention can be implemented in any system for which helical antenna technology can be utilized. One example of such an environment is a communication system in which users having fixed, mobile and/or portable telephones communicate with other parties through base station cells and/or through a satellite communication link. In the satellite communications example environment, the telephone is required to have an antenna tuned to the frequency of the satellite communication link.

The present invention is described in terms of this example environment. Description in these terms is provided for convenience only. It is not intended that the invention be limited to application in this example environment. In fact, after reading the following description, it will become apparent to a person skilled in the relevant art how to implement the invention in alternative environments, such as terrestrial cellular telephones and related wireless communications devices.

III. Helical Antenna Support Assembly

Figure 1:
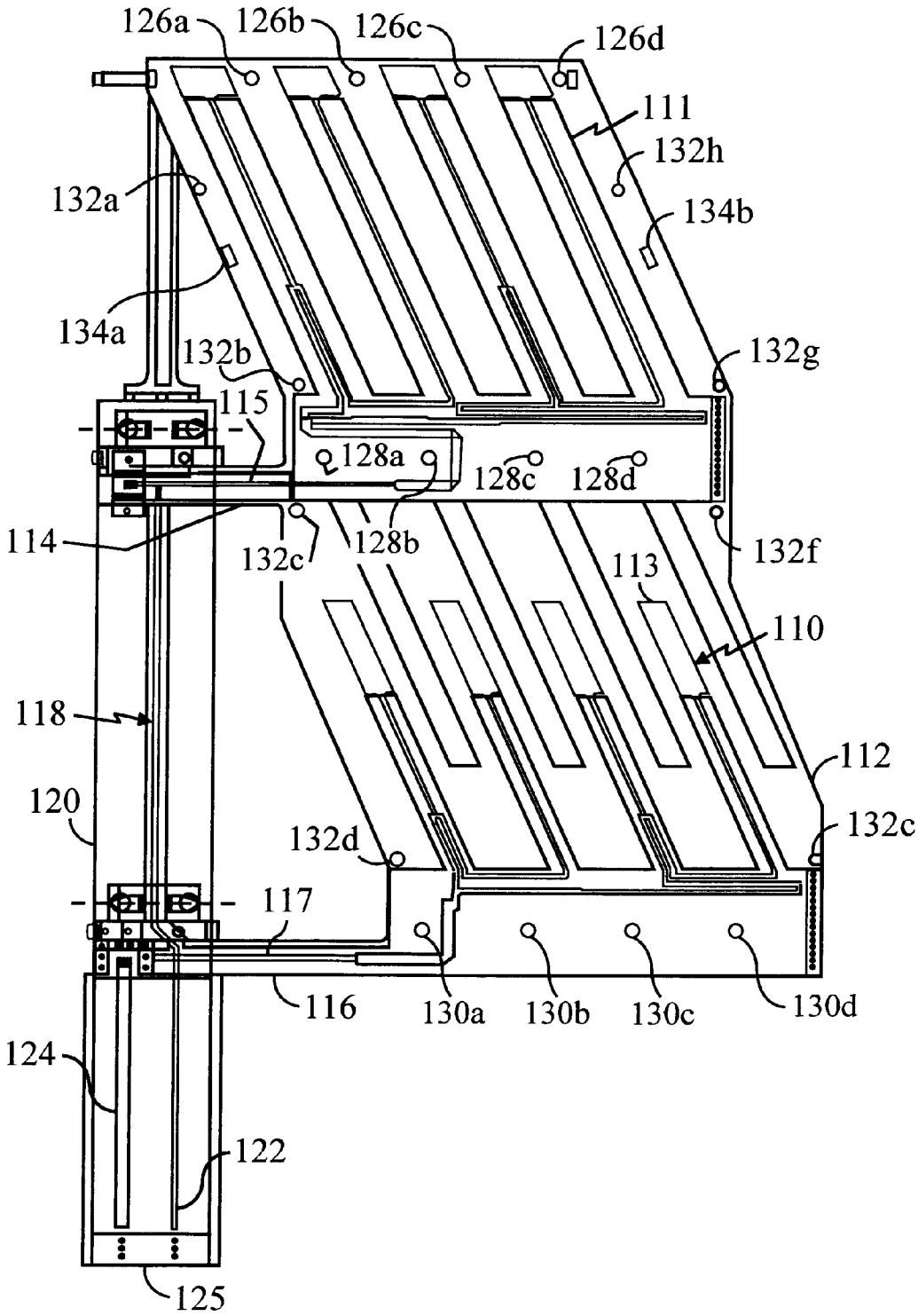
FIG. 1 shows the assembled helical antenna with the radiator elements flattened prior to being wound around the center feed element.

FIG. 1 shows the assembled helical antenna with the radiator elements flattened prior to being wound around the center feed element. A helical radiator portion 110 is etched or deposited or otherwise formed on a flexible substrate 112. In the embodiment shown, the radiator portion 110 is composed of a quadrifilar helix having an upper transmit portion 111 and a lower receive portion 113. It would be apparent to one skilled in the antenna art that other helical antenna radiator designs, such as monofilar helices, could be readily substituted for the quadrifilar shown in this example. Extending from and forming part of the flexible substrate are two tab like portions 114 and 116. Tabs 114 and 116 have electrical leads 115 and 117, respectively, etched or deposited or otherwise formed thereon.

A center feed element 118 is composed of an elongated strip of conductive material deposited or etched on a multi-layer rigid substrate member 120. A receive filter and a low noise amplifier (LNA) may also be deposited or etched or otherwise formed on rigid substrate 120 in a known manner.

Center feed element 118 extends axially outwardly of the helix to form a connecting lead 122. Feed element 118 and its connecting lead 122 form a signal path between a signal source (not shown) and transmit portion 111. A second connecting lead 124 connects lead 117 and receive portion 113 to a receiver circuit (not shown) in the communication device. If used, the receive filter and LNA would typically be located in the path of connecting lead 124.

In one exemplary embodiment, connecting leads 122 and 124 extend through an end cap 125 for connecting the antenna to other components of the transmission/reception circuits within the communications unit. In a second exemplary embodiment, connectors, or a single coaxial connector, can be molded directly into end cap 125. In this embodiment, leads 122 and 124 terminate inside the antenna unit at the connector(s). The advantage of this design is that it significantly reduces vapor leakage into the antenna. Typically, moisture can migrate into the antenna unit through the spacing between the insulation and conductors of the connecting leads. However, with the alternative design described above, the connecting leads do not extend through the end cap, thereby eliminating this path of potential moisture migration into the antenna.

Tabs 114 and 116 are physically connected to connecting points of rigid substrate 120 by, for example, soldering, or adhesives and conductive compounds, such that leads 115 and 117 are electrically connected to feed element 118 and connecting lead 124, respectively. This provides electrically conducting paths through radiator portions 111 and 113, respectively. The electrical configuration of a helical antenna of the type to which this invention relates is well known, and is described in, for example, U.S. patent application Ser. No. 08/826,289, entitled "A Center-Fed Quadrafilar Corporate Feed," filed Mar. 27, 1997 to D. Filipovic, et al, and commonly assigned with the present invention.

Flexible substrate 112 contains several series of holes or apertures (or passages) 126, 128, and 130, that are intended to register with support members on rigid substrate 120, as will be described below. Substrate 112 also has a further set of holes or apertures (or passages) 132 that are intended to register with corresponding openings in an assembly tool, also as described below. Finally, substrate 112 contains a plurality of soldering tabs 134 that register with each other when the flexible substrate is wound around the support structure assembly and are then soldered or otherwise bonded together to hold the wound helix in place.

Figure 2A:
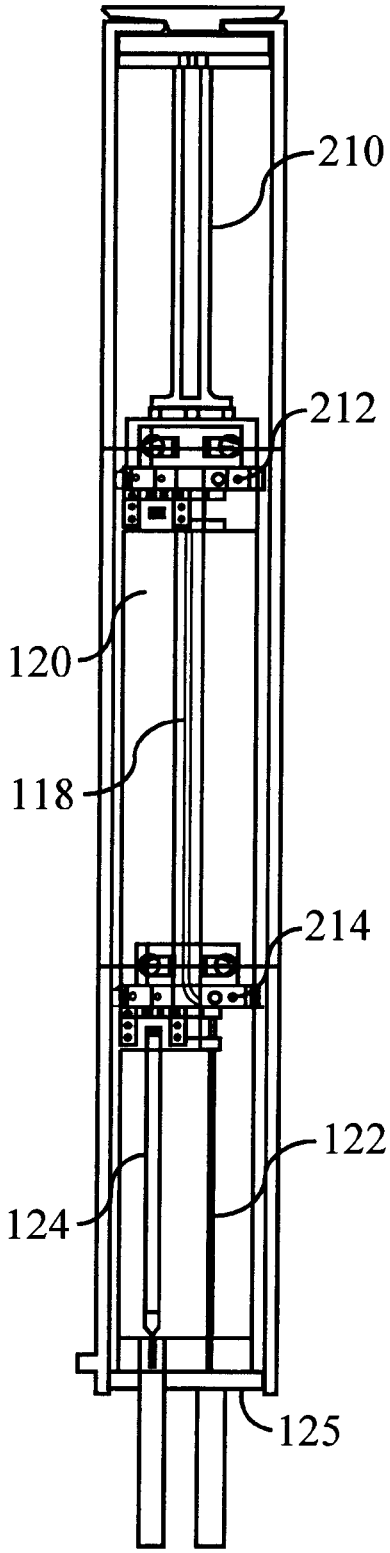
FIGS. 2A and 2B show plan and side views, respectively, of the flexible substrate support assembly without the flexible substrate in position.
Figure 2B:
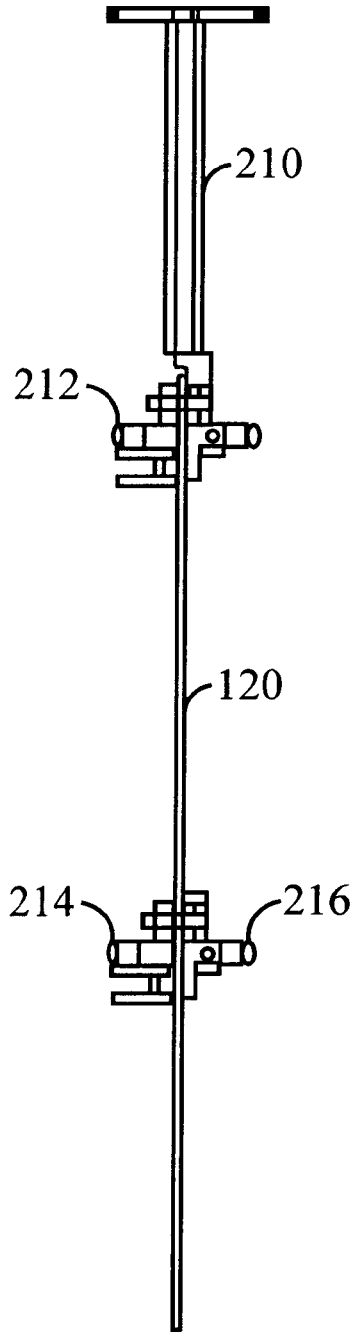
Figure 2C:
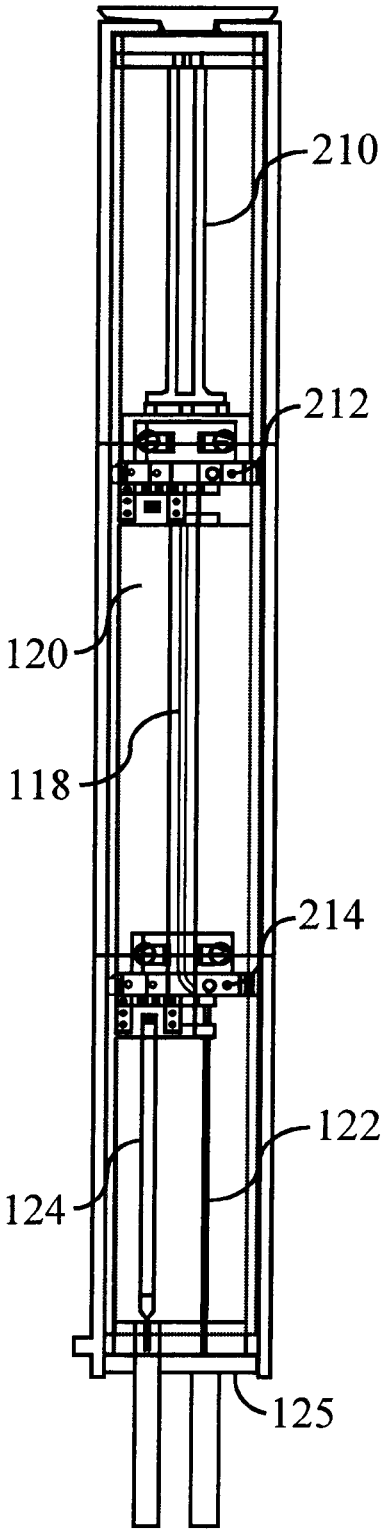
FIGS. 2C and 2D show plan and side views, respectively, of the flexible substrate support assembly, with the flexible substrate in position.
Figure 2D:
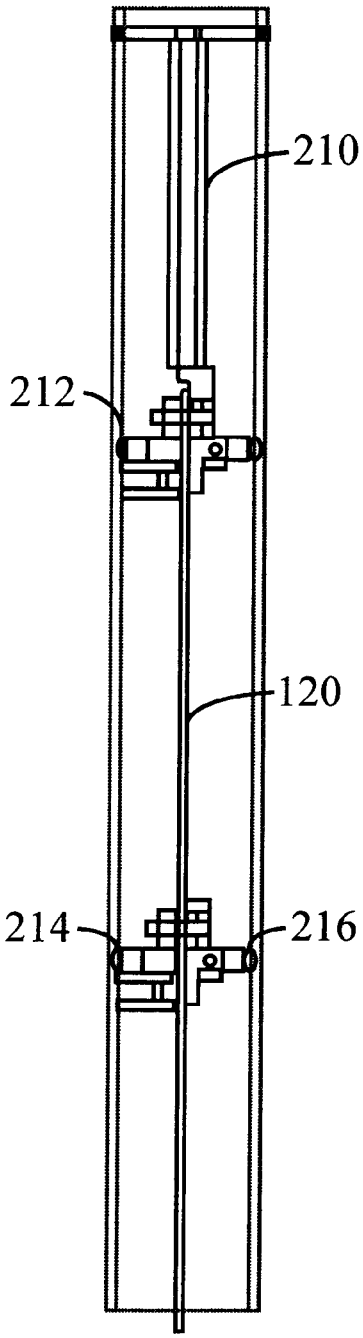

FIGS. 2A and 2B show the flexible substrate support assembly of this invention without the flexible substrate in position, while FIGS. 2C and 2D show the flexible substrate support assembly, with the flexible substrate in position. The support assembly includes a first support member 210, which is mounted to one surface of rigid substrate 120, generally at or near one end of the substrate. A second support member 212 is mounted to the opposite surface of rigid substrate 120 at the same end thereof as first support member 210. A third support member 214 is mounted to rigid substrate 120 axially spaced from support member 210 and generally located at or near the opposite end of rigid substrate 120 from support members 210 and 212. A fourth support member 216 is mounted to rigid substrate 120 on the opposite surface to and at the same end as support member 214. Support members 212 and 214 are virtually identical in construction. The four support members are all made of a non-conductive material, such as plastic.

Figure 3A:
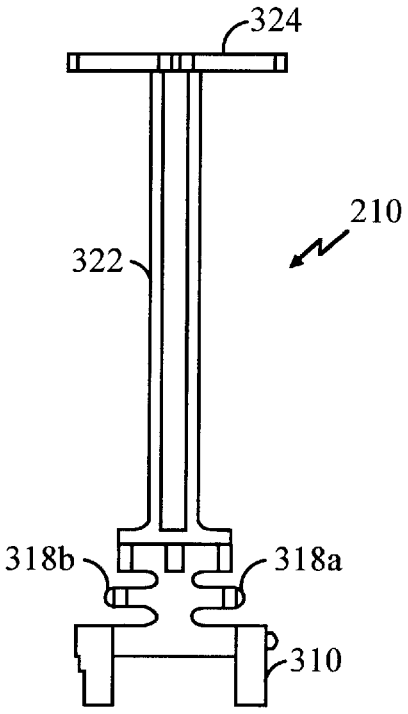
FIGS. 3A and 3B show plan and side views, respectively, of the first support member.
Figure 3B:
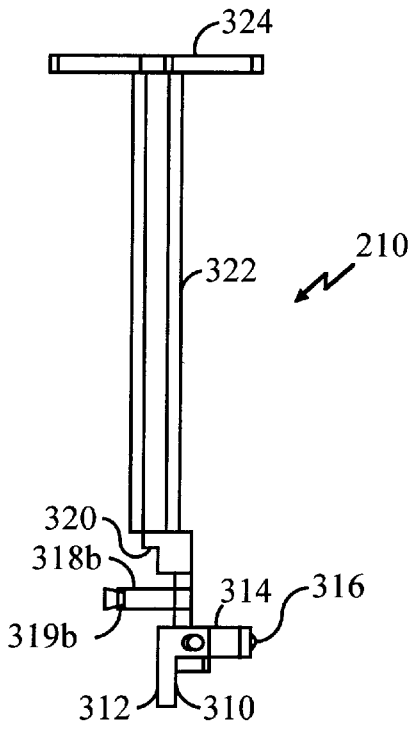

FIGS. 3A and 3B show plan and side views of first support member 210. Support member 210 has a first end portion 310 that includes a flat under surface 312. When first support member 210 is mounted to rigid substrate 120, flat surface 312 rests against the surface of the rigid substrate. End portion 310 also includes a projection 314 that, when support member 210 is mounted to the rigid substrate, extends outwardly from the substrate surface and defines a generally part circular surface. The surface of projection 314 supports the flexible substrate as it is wound around rigid substrate 120 to ultimately form the helical antenna. A further pin-like projection 316 extends outwardly from the surface of projection 314. The purpose of projection 316 will be described in more detail below.

A pair of leg portions 318*a* and 318*b* extend outwardly from support member 210 in the opposite direction from projections 314 and 316. Legs 318 have prongs or barbs thereon (only barb 319*b* is shown in FIG. 3B). Leg portions 318 extend through corresponding holes in rigid substrate 120 when support member 210 is mounted thereto. A right angle stop portion 320 is formed on support member 210 adjacent leg portions 318. A purpose of stop portion 320 is to act as a guide for positioning support member 210 against the edge of rigid substrate 120 when mounting the support member to the substrate.

An elongated portion of support member 210 comprises a set of extension arms 322 which extend axially outwardly from end portion 310 to an end cap 324. The preferred embodiment of this design has arms. These arms could be replaced by a solid element; however, an extension arm design is preferred to save weight and material. The length of the extension arms is a function of the desired length of the antenna as a whole. As will be discussed in more detail below, the flexible substrate wraps around rigid substrate 120 and support member 210.

Figure 4:
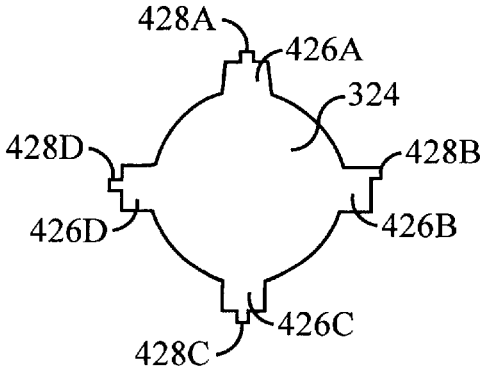
FIG. 4 shows a plan view of the end cap.

FIG. 4 shows a plan view of end cap 324. End cap 324 is secured to extension arms 322 in a known manner, such as by glue, heat welding, or the like. End cap 324 is essentially circular in shape and has four projections 426*a–d* extending radially outwardly from the edge surface of the end cap. Each projection 426 has an additional projection 428 extending radially outwardly from the outer face of its respective projection 426. As discussed in more detail below, projections 428 mate with corresponding holes in flexible substrate 112 to secure the flexible substrate as it is rolled around the support members.

Figure 5C:
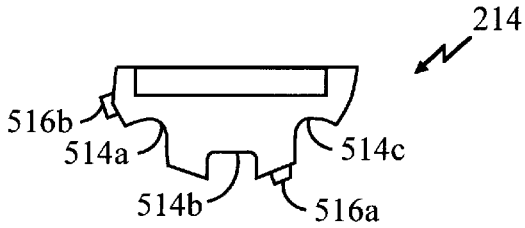
FIGS. 5A–C show plan, side and end views, respectively, of the second and third support members.
Figure 5A:
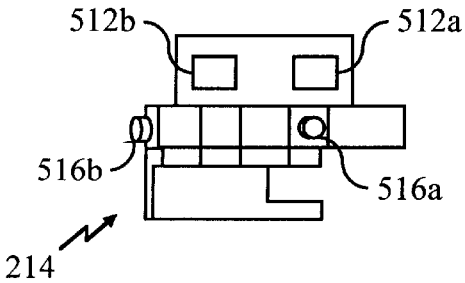
Figure 5B:
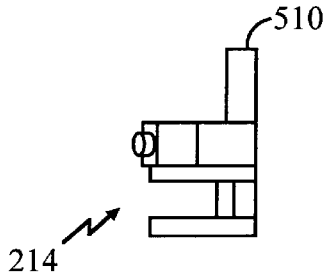

FIGS. 5A–C show plan, side and end views, respectively, of support member 214. As noted above, support members 212 and 214 are virtually identical. The following description of support member 214 applies as well to support member 212. This member has a flat surface 510 that rests against the surface of rigid substrate 120 when support member 214 is mounted to substrate 120. Surface 510 contains a pair of openings 512*a* and 512*b* that mate with corresponding openings in substrate 120 when member 214 is mounted in position. As can be seen clearly in FIG. 5C, member 214 has a part circular surface configuration with notched or indented portions 514*a*, 514*b*, and 514*c*, and projections 516*a* and 516*b* extending outwardly from the part circular surface, and spaced from each other at an angle of approximately 90°. Notched portions 514 are provided for receiving the fingers of an assembly tool, as will be described below. Projections 516 mate with corresponding holes in the flexible substrate as the flexible substrate is rolled around the support assembly.

Figure 6C:
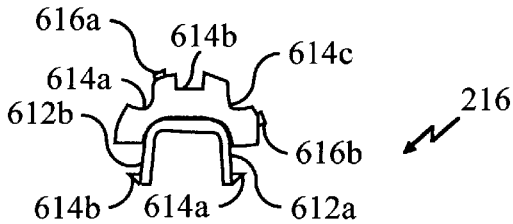
FIGS. 6A–C show plan, side and end views, respectively, of the fourth support member.
Figure 6A:
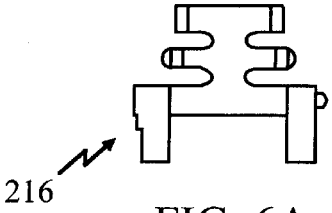
Figure 6B:
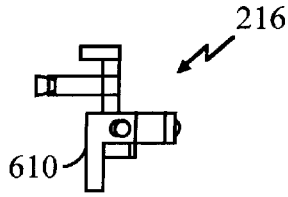

FIGS. 6A–C show plan, side and end views, respectively, of support member 216. Support member 216 has a flat surface 610 that rests against the surface of rigid substrate 120 when support member 216 is mounted to substrate 120. Member 216 also has a pair of legs 612*a* and 612*b* with prongs or barbs, respectively, formed thereon. Legs 612*a* and 612*b* extend through holes in rigid substrate 120 and through openings 512*a* and 512*b* in support member 214. Barbed portions 614*a* and 614*b* engage openings 512*a* and 512*b* in support member 214 to lock the two support members together against the opposite surfaces of substrate 120. As can be seen clearly in FIG. 6C, member 216 has a part circular surface configuration with notched or indented portions 614*a*, 614*b*, and 614*c*, and projections 616*a* and 616*b* extending outwardly from the part circular surface and spaced from each other at an angle of approximately 90°. Notched portions 614 are provided for receiving the fingers of an assembly tool, as will be described below. Projections 616 mate with corresponding holes in the flexible substrate as the flexible substrate is rolled around the support assembly.

In like manner as the mating of support members 214 and 216, leg portions 318 of support member 210 extend through the corresponding openings in the surface of support member 212. Barbs 319 engage the openings in the face of support member 212 and securely lock the two support members together against the opposite surfaces of substrate 120.

IV. Helical Antenna Assembly Tool

A second aspect of the present invention relates to a tool for assembling the helical antenna described above. It is highly desirable to be able to easily wind the flexible substrate onto the support assembly so that the center feed is maintained along the longitudinal axis of the cylinder defined by the helically wound radiators on the flexible substrate and the edges of the flexible substrate can be aligned to be soldered at appropriate points to complete the electrical path.

Figure 7A:
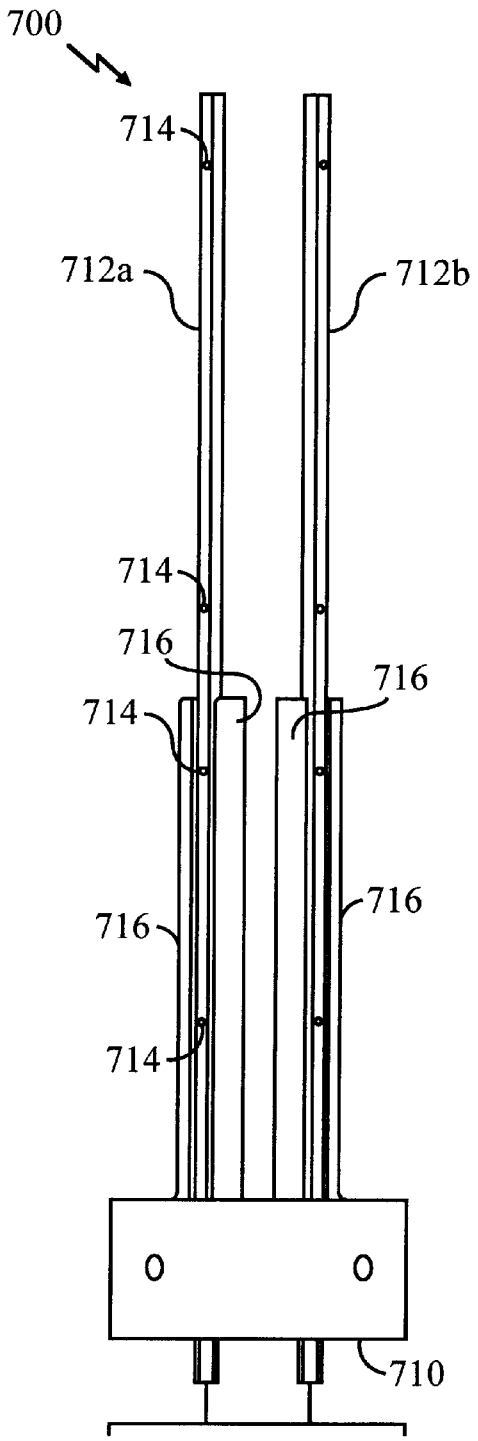
FIGS. 7A and 7B show plan and end views, respectively, of the assembly tool of this invention.
Figure 7B:
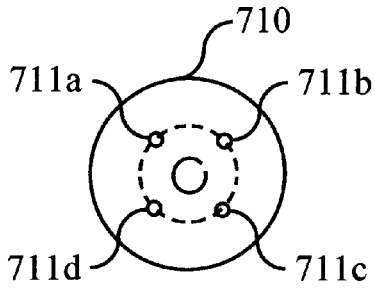

FIGS. 7A and 7B show plan and end views, respectively, of an assembly tool 700. Tool 700 includes a base member 710. Base member 710 may be made of plastic, stainless steel, or any other suitably rigid material. Base member 710 may be long enough to be held by a user's hand; or it may be made to mount in a machine tool as part of a robotic or automated assembly mechanism. In a prototype version, base member 710 has four openings 711*a*, 711*b*, 711*c*, and 711*d* formed therein spaced equidistant around a circular pattern. That is, holes 711 are spaced 90° apart around the central axis of the base member.

Elongated finger members 712 are mounted in holes 711 (only fingers 712*a* and 712*b* are shown in FIG. 7A). The length of the fingers is determined by the length of the assembled rigid substrate 120 and support members 210, 212, 214, and 216. Fingers 712 should be long enough to extend through the notches in each of the support members. A plurality of holes 714 are formed in each of fingers 712. These holes are spaced along the length of each finger a distance corresponding to the location of respective holes in flexible substrate 112.

Assembly tool 700 also has mandrels 716 that substantially surround a portion of fingers 712. When the assembly tool is inserted through the notches in the support members, the mandrels butt up against the outer face of end cap 324. This limits the extent to which the tool can be inserted into its operative position. The mandrels also act as further support for the flexible substrate as it is wound around the rigid substrate and center feed.

V. Assembly Method

The method of assembling the helical antenna using the assembly tool will now be described.

Rigid substrate 120 is pre-assembled with support members 210, 212, 214, and 216. Support member 210 is mounted to substrate 120 such that leg portions 318 extend through corresponding openings in substrate 120. Support member 212 is then mounted to substrate 120 such that the openings in the flat surface thereof are aligned with leg portions 318. Support member 212 is then snap-fitted to leg portions 318 and is held in place by barb portions 319 on legs 318. In this way, support members 210 and 212 are secured to substrate 120 on opposite sides thereof. The edge surfaces of support member 212 and projection 314 of support member 210 are radially aligned to thereby define a generally circular support surface for supporting the flexible substrate as it is wound around rigid substrate 120.

In a similar manner, support members 214 and 216 are mounted to substrate 120 axially spaced from support members 210 and 212. Support members 212 and 214 are mounted generally near or at an end of the substrate opposite the end to which support members 210 and 212 are mounted. Support member 216 is mounted to substrate 120 such that leg portions 612 extend through openings in substrate 120. Support member 214 is then mounted to substrate 120 such that openings 512 are in registration with the openings in the substrate and leg portions 612 extend through openings 512. Leg portions 612 then snap-fit to support member 214 and are held in place by barbs 614. In this way, support members 214 and 216 are secured to substrate 120 on opposite sides thereof and in radial alignment with each other to thereby define a generally circular support surface for supporting the flexible substrate as it is wound around rigid substrate 120.

At this point also, flexible substrate 112 is mounted or secured to the subassembly. Tabs 114 and 116 are secured to substrate 120 in such manner that electrical leads 115 and 117 make proper electrical contact with center feed 118. This can be done in any conventional manner, as by soldering, crimping, or the like. Once tabs 114 and 116 have been secured to substrate 120, these tie down points effectively secure flexible substrate 112 against rotation as it is wound around the subassembly and assembly tool.

Once rigid substrate 120 and support members 210, 212, 214, and 216 have been assembled, assembly tool 700 is fitted around the rigid substrate-support member subassembly. Fingers 714 of assembly tool 700 are slid longitudinally along the subassembly such that fingers 714 pass through the notches in the support members. The direction of insertion of the tool is typically from the combination of support members 210, 212 toward support members 214, 216. In the prototype version of the tool, the fingers extend longitudinally only to the extent of the faces of mandrels 716. However, as noted above, the fingers are long enough to extend to support members 214, 216.

As the flexible substrate is wound around the subassembly and tool 700, holes 126, 128, and 130 come into registration with corresponding projections 316, 428, 516 and 616 on support members 210, 212, 214, and 216. Also, holes 132 in the flexible substrate come into registration with holes 714 in fingers 712 of tool 700. Pins may then be inserted through the holes in the flexible substrate and the corresponding holes in fingers 712. This further fixes the flexible substrate in place so that when it is completely wound on the subassembly, solder points 132*f*, 132*g*, 134*a* and 134*b* on the flexible substrate mate with each other and solder can be applied to these solder points to hold the flexible substrate in place and prevent it from unwinding.

After the flexible substrate has been fully wound on the subassembly and soldered as described above, the pins holding the flexible substrate to the assembly tool can be removed. The assembly tool is then removed, leaving a properly formed helical antenna with the center feed running correctly down the longitudinal axis of the cylinder defined by the helically wound flexible substrate. Coaxial RF connectors are then soldered or otherwise connected to leads 122 and 124 at the axial end of substrate 120.

Finally, a plastic radome shield is fitted over the antenna elements to protect the antenna elements. Radome shields are well known. A feature of the present invention is that the several projections 316, 428, 516, and 616 act as guides and spacers for the radome. The inner surface of the radome butts up against the projections, all of which project the same distance from the centers of the circles defined by the shape of the combination of support elements 210, 212, 214, and 216. Thus, when the radome is slid over the helical antenna elements, it will be spaced evenly and equally from the radiators, thereby minimizing the distortion that otherwise can occur in conventional helical antennas that do not include these spacer elements.

Another feature of the present invention concerns its ability to minimize the possibility of vapor seeping into the antenna assembly, thereby distorting the resonance. After the antenna has been assembled and the assembly tool removed, sealing cap 125 is placed over the open end. Typically, the lead wires for connecting the antenna to the rest of the electronic circuit elements extend through the sealing cap. However, it has been found that water vapor can seep through the lead wires, typically between the insulation and the conductive element, into the antenna. This results in de-tuning the antenna and lowering its gain. By contrast, in the present invention, leads 122 and 124 terminate in connectors mounted directly to the end cap. This avoids exposing the wires simultaneously to the sealed interior and the ambient atmosphere and thereby minimizes vapor leakage into the antenna package.

Figure 8A:
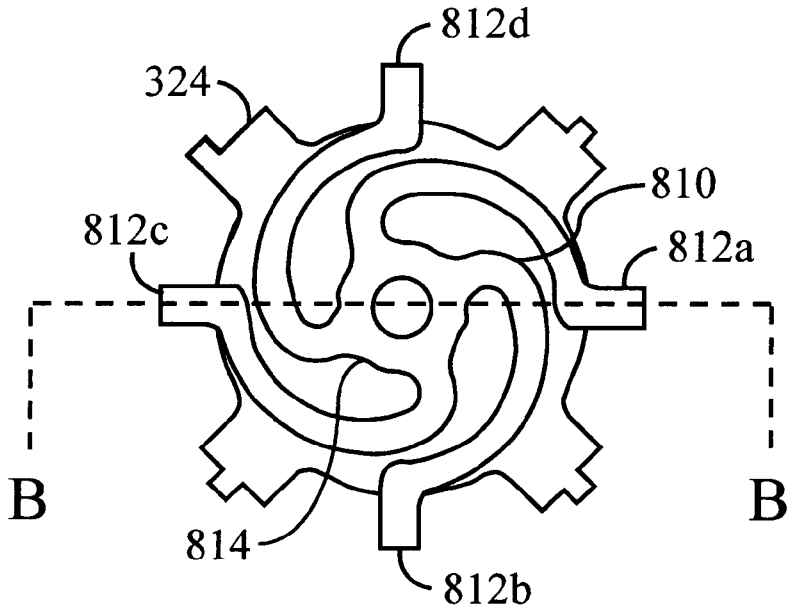
FIG. 8A shows a plan view of a tuning cap of the invention.
Figure 8B:
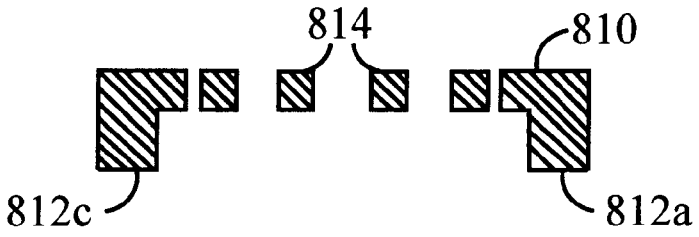
FIG. 8B shows a cross-sectional view of a tuning cap taken along lines B—B in FIG. 8A.

A still further feature of the invention relates to fine tuning of the antenna following assembly as described above and prior to fitting the radome in place. Fine tuning is achieved by using a tuning cap 810, an example of which is shown in FIGS. 8A and 8B, that fits over cap 324. Tuning cap 810 has four legs 812*a–d* that extend from a central region 814 spirally and axially of the cylinder formed by the wound flexible substrate 110. Tuning cap 810 may be made of plastic, or any other suitable material having satisfactory antenna tuning characteristics. Tuning cap 810 is friction fitted to cap 324 and is rotatable thereon. As tuning cap 810 is rotated, legs 812 begin to cover a portion of radiator elements 112. This coverage affects the resonant frequency of the radiators and enables them to be fine tuned. Once optimum tuning has been accomplished, the radome can be fitted over the finished antenna assembly and sealed to end cap 125.

Figure 9A:
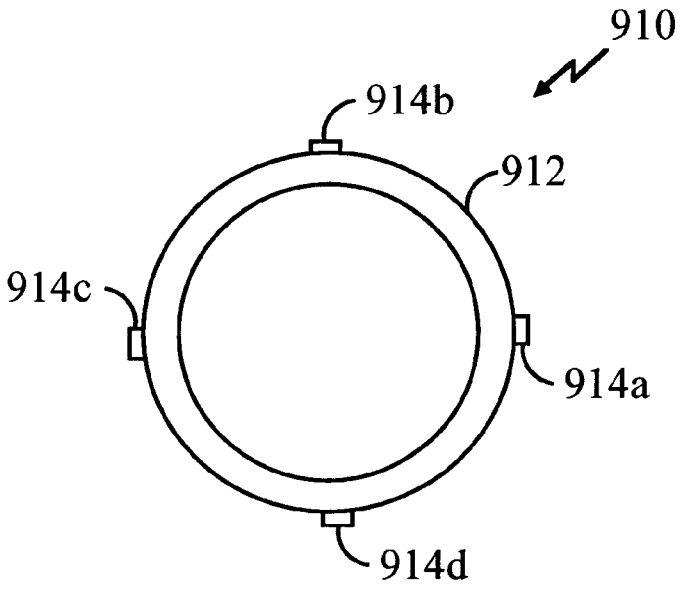
FIGS. 9A and 9B show plan and side views, respectively, of a second embodiment of a tuning cap.
Figure 9B:
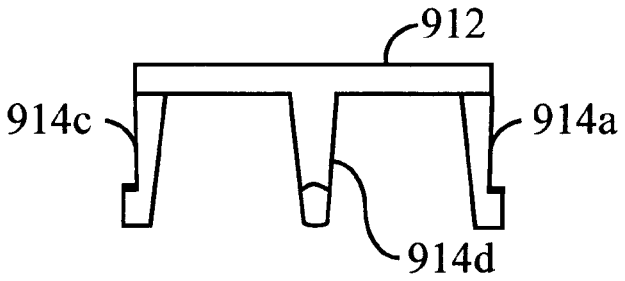

Another example of a suitable tuning cap is shown in FIGS. 9A and 9B. Tuning cap 910 has a ring portion 912. Four legs 914*a–d* extend from ring portion 912 axially of the cylinder formed by the wound flexible substrate 110. Tuning cap 910 is fitted to end cap 324 and in all other significant respects operates in the same manner as tuning cap 810.

VI. Conclusion

While various embodiments of the present invention have been described above, it should be understood that they have been presented by way of example only, and not limitation. It will be understood by those skilled in the art that various changes in form and details may be made therein without departing from the spirit and scope of the invention. Thus, the breadth and scope of the present invention should not be limited by any of the above-described exemplary embodiments, but should be defined only in accordance with the following claims and their equivalents.

What we claim as our invention is:

1. A helical antenna, comprising:

a flexible substrate having at least one radiator portion formed thereon and having at least one tab formed on said substrate supporting a feed for feeding signals to radiators formed on said flexible substrate;

a planar rigid substrate having a center feed element formed thereon which is electrically connected to said radiator portion; and a support assembly for supporting said flexible substrate in a substantially surrounding relation to said rigid substrate such that said center feed element is spaced substantially equidistant from said radiator portion, said support assembly comprising:

a first support member mounted to one surface of said planar rigid substrate at a first location, a second support member mounted to a second opposing surface of said planar rigid substrate at said first location, a third support member mounted to said one surface of said planar rigid substrate at a second location spaced from said first location, and a fourth support member mounted to said second opposing surface of said planar rigid substrate at said second location.

2. A helical antenna according to claim 1, wherein said first and second support members are mounted to said rigid substrate in substantial radial alignment with each other to define a generally circular support surface for supporting said flexible substrate.

3. A helical antenna according to claim 2, wherein said third and fourth support members are mounted to said rigid substrate in substantial radial alignment with each other to define a generally circular support surface for supporting said flexible substrate.

4. A helical antenna according to claim 1, wherein said third and fourth support members are mounted to said rigid substrate in substantial radial alignment with each other to define a generally circular support surface for supporting said flexible substrate.

5. A helical antenna according to claim 1, further comprising a feed network formed on said flexible substrate.

6. A helical antenna according to claim 1, further comprising a second radiator portion formed on said flexible substrate.

7. A helical antenna according to claim 1, further comprising a second radiator portion formed on said flexible substrate.

8. A helical antenna according to claim 1, further comprising a series of soldering pads formed on said substrate for registering with each other in pairs during formation of said antenna and for receiving solder to secure said substrate in a desired assembled position.

9. A helical antenna, comprising:

a flexible substrate having a radiator portion formed thereon;

a rigid substrate having a center feed element formed thereon which is electrically connected to said radiator portion;

a support assembly for supporting said flexible substrate in a substantially surrounding relation to said rigid substrate such that said center feed element is spaced substantially equidistant from said radiator portion, said support assembly comprising:

a first support member mounted to one surface of said rigid substrate at a first location, a second support member mounted to a second surface of said rigid substrate at said first location, a third support member mounted to said one surface of said rigid substrate at a second location spaced from said first location, and a fourth support member mounted to said second surface of said rigid substrate at said second location; and a plurality of projections extending radially outward from the support surfaces of said support members, said projections registering with corresponding holes formed in said flexible substrate when said flexible substrate is wound on said support assembly.

10. A helical antenna according to claim 9, further comprising:

a cover member for substantially concentrically covering said flexible substrate, said rigid substrate and said support assembly, wherein said projections contact said cover member to act as spacers for spacing said cover member from said flexible substrate.

11. A helical antenna according to claim 10, wherein:

when said flexible substrate is wound around said support assembly, said flexible substrate defines a substantially cylindrical shape having a central longitudinal axis; and said projections extend substantially radially equidistant from a central longitudinal axis of said rigid substrate and the longitudinal axis of said flexible substrate is substantially coincident with the central longitudinal axis of said rigid substrate.

12. A helical antenna, comprising:

a flexible substrate having a radiator portion formed thereon;

a rigid substrate having a center feed element formed thereon which is electrically connected to said radiator portion;

a support assembly for supporting said flexible substrate in a substantially surrounding relation to said rigid substrate such that said center feed element is spaced substantially equidistant from said radiator portion, said support assembly comprising:

a first support member mounted to one surface of said rigid substrate at a first location, said first support member including an elongated portion extending axially of said rigid substrate and having one end portion disposed proximate to said rigid substrate, and an end cap coupled to said elongated portion at a second end portion distal from said rigid substrate, said end cap having a generally circular support surface for supporting said flexible substrate;

a second support member mounted to a second surface of said rigid substrate at said first location, a third support member mounted to said one surface of said rigid substrate at a second location spaced from said first location, and a fourth support member mounted to said second surface of said rigid substrate at said second location.

13. A helical antenna, comprising:

a flexible substrate having a radiator portion formed thereon;

a rigid substrate having a center feed element formed thereon which is electrically connected to said radiator portion; and a support assembly for supporting said flexible substrate in a substantially surrounding relation to said rigid substrate such that said center feed element is spaced substantially equidistant from said radiator portion, said support assembly comprising:

a first support member mounted to one surface of said rigid substrate at a first location, a second support member mounted to a second surface of said rigid substrate at said first location, a third support member mounted to said one surface of said rigid substrate at a second location spaced from said first location, and a fourth support member mounted to said second surface of said rigid substrate at said second location; and a tuning cap fitted to said support assembly and having a plurality of tuning elements extending axially in the direction of said central longitudinal axis, said tuning cap being rotatable about said central longitudinal axis to cause said tuning elements to adjustably overlap at least portions of said radiator portion.

14. A helical antenna according to claim 13, wherein said plurality of tuning elements are spaced equidistantly around said central longitudinal axis.

15. A helical antenna according to claim 14, wherein said tuning cap has four tuning elements extending axially in the direction of said central longitudinal axis and equidistantly spaced around said central longitudinal axis.

16. A helical antenna, comprising:

a flexible substrate having a radiator portion formed thereon;

a rigid substrate having a center feed element formed thereon which is electrically connected to said radiator portion;

a support assembly for supporting said flexible substrate in a substantially surrounding relation to said rigid substrate such that said center feed element is spaced substantially equidistant from said radiator portion, said support assembly comprising:

a first support member mounted to one surface of said rigid substrate at a first location, a second support member mounted to a second surface of said rigid substrate at said first location, a third support member mounted to said one surface of said rigid substrate at a second location spaced from said first location, and a fourth support member mounted to said second surface of said rigid substrate at said second location; and an end cap coupled to one end of said first support member and spaced from said rigid substrate, said end cap having a generally circular support surface for supporting said flexible substrate; and an electrical connector fitted into said end cap, said electrical connector providing an electrical connection to said radiator portion and center feed element and connectable to an external electrical lead for connecting the antenna elements to other circuit components.

17. A tool for assembling a helical antenna including a flexible substrate having a radiator portion formed thereon, a rigid substrate having a center feed element formed thereon which is electrically connected to the radiator portion, and a support assembly for supporting the flexible substrate in a substantially surrounding relation to the rigid substrate, said assembly tool comprising:

a base member;

a plurality of elongated members extending outwardly from said base member and mounted to said base member substantially equidistant from each other; and a plurality of holes formed in each of said elongated members for removably receiving pins when said holes are in registration with corresponding holes in the flexible substrate.

18. An assembly tool according to claim 17, wherein said elongated members extend outwardly from said base in substantially parallel relationship with each other.

19. An assembly tool according to claim 17, wherein said support assembly comprises:

first and second support members mounted to first and second surfaces, respectively, of the rigid substrate at a first location in substantial radial alignment with each other to define a generally circular support surface for supporting the flexible substrate;

third and fourth support members mounted to said first and second surfaces, respectively, of the rigid substrate at a second location spaced from said first location in substantial radial alignment with each other to define a generally circular support surface for supporting the flexible substrate; and a plurality of apertures formed in each of said support members such that the apertures in said first and third support members are axially aligned and the apertures in said second and fourth support members are axially aligned; wherein:

said elongated members of said assembly tool extend through respective corresponding apertures in said first and third support members and said second and fourth support members when said assembly tool is in an operative relationship with the support assembly and the rigid substrate to permit mounting the flexible substrate thereon.

20. An assembly tool according to claim 19, wherein said elongated members extend outwardly from said base member in substantially parallel relationship with each other.

21. An assembly tool according to claim 19, wherein said elongated members extend outwardly from said base member in substantially parallel relationship with each other.

22. A helical antenna, comprising:

a flexible substrate having at least one radiator portion formed thereon and having at least one tab formed on said substrate supporting a feed for feeding signals to radiators formed on said flexible substrate a planar rigid substrate having a center feed element formed thereon which is electrically connected to said radiator portion; and a support assembly for supporting said flexible substrate in a substantially surrounding relation to said rigid substrate such that said center feed element is spaced substantially equidistant from said radiator portion, said support assembly comprising:

a first support member disposed at a first location on said rigid substrate, and a second support member disposed at a second location on said rigid substrate.

23. A helical antenna according to claim 22, wherein said first and second support members each defines a generally circular support surface for supporting said flexible substrate.

24. A helical antenna according to claim 22, further comprising a feed network formed on said flexible substrate.

25. A helical antenna according to claim 22, further comprising a series of soldering pads formed on said substrate for registering with each other in pairs during formation of said antenna and for receiving solder to secure said substrate in a desired assembled position.

26. A helical antenna, comprising:

a flexible substrate having a radiator portion formed thereon;

a rigid substrate having a center feed element formed thereon which is electrically connected to said radiator portion;

a support assembly for supporting said flexible substrate in a substantially surrounding relation to said rigid substrate such that said center feed element is spaced substantially equidistant from said radiator portion, said support assembly comprising:

a first support member disposed at a first location on said rigid substrate which defines a generally circular support surface for supporting said flexible substrate; and a second support member disposed at a second location on said rigid substrate which defines a second generally circular support surface for supporting said flexible substrate; and a plurality of projections extending radially outward from the support surfaces of said support members, said projections registering with corresponding holes formed in said flexible substrate when said flexible substrate is wound on said support assembly.

27. A helical antenna according to claim 26, wherein:

when said flexible substrate is wound around said support assembly, said flexible substrate defines a substantially cylindrical shape having a central longitudinal axis; and said projections extend substantially radially equidistant from a central longitudinal axis of said rigid substrate and the longitudinal axis of said flexible substrate is substantially coincident with the central longitudinal axis of said rigid substrate.

28. A helical antenna according to claim 27, further comprising:

a tuning cap fitted to said support assembly and having a plurality of tuning elements extending axially in the direction of said central longitudinal axis of said rigid substrate, said tuning cap being rotatable about said central longitudinal axis to cause said tuning elements to adjustably overlap at least portions of said radiator portion.

29. A helical antenna, comprising:

a flexible substrate having a radiator portion formed thereon;

a rigid substrate having a center feed element formed thereon which is electrically connected to said radiator portion; and a support assembly for supporting said flexible substrate in a substantially surrounding relation to said rigid substrate such that said center feed element is spaced substantially equidistant from said radiator portion, said support assembly comprising:

a first support member disposed at a first location on said rigid substrate, and a second support member disposed at a second location on said rigid substrate; and a tuning cap fitted to said support assembly and having a plurality of tuning elements extending axially in the direction of said central longitudinal axis, said tuning cap being rotatable about said central longitudinal axis to cause said tuning elements to adjustably overlap at least portions of said radiator portion.

30. A helical antenna according to claim 29, wherein said plurality of tuning elements are spaced equidistantly around said central longitudinal axis.

31. A helical antenna according to claim 30, wherein said tuning cap has four tuning elements extending axially in the direction of said central longitudinal axis and equidistantly spaced around said central longitudinal axis.

32. A helical antenna comprising:

a flexible substrate having a radiator portion formed thereon;

a rigid substrate having a center feed element formed thereon which is electrically connected to said radiator portion; and a support assembly for supporting said flexible substrate in a substantially surrounding relation to said rigid substrate such that said center feed element is spaced substantially equidistant from said radiator portion, said support assembly comprising:

a first support member disposed at a first location on said rigid substrate, and a second support member disposed at a second location on said rigid substrate;

an end cap coupled to said first support member and having a generally circular support surface for supporting said flexible substrate; and an electrical connector fitted into said end cap, said electrical connector providing an electrical connection to said radiator portion and center feed element and connectable to an external electrical lead for connecting the antenna elements to other circuit components.

* * * * *